US006212869B1

(12) United States Patent
Sadowsky

(10) Patent No.: US 6,212,869 B1
(45) Date of Patent: Apr. 10, 2001

(54) JEWELRY LINK ASSEMBLY

(75) Inventor: Alexander Sadowsky, Maspeth, NY (US)

(73) Assignee: Sandberg & Sikorski Diamond Corp., New York, NY (US)

( * ) Notice: Subject to any disclaimer, the term of this patent is extended or adjusted under 35 U.S.C. 154(b) by 0 days.

(21) Appl. No.: 09/517,794

(22) Filed: Mar. 2, 2000

(51) Int. Cl.[7] ..... A44C 5/02
(52) U.S. Cl. ..... 59/80; 59/82; 63/4
(58) Field of Search ..... 63/4, 9, 7; 59/80, 59/82

(56) References Cited

U.S. PATENT DOCUMENTS 1,173,427 * 2/1916 Heyman ..... 59/80
1,443,512 * 1/1923 Veigel ..... 59/80
1,843,555 * 2/1932 Goldblatt ..... 59/80
5,347,498 * 9/1994 Loth et al. ..... 59/80

* cited by examiner

*Primary Examiner*—David Jones
(74) *Attorney, Agent, or Firm*—Gottlieb, Rackman & Reisman, P.C.

(57) ABSTRACT

A link assembly for a link bracelet is provided. The link assembly includes a first link member formed with a male link element at one end and a second link member formed with a female link element at one end that is designed for pivotally and matingly engaging with the male link element of the first link member. The male link element is constructed with a first bore formed therethrough and the female element has second and third bores formed therethrough. The second and third bores are disposed on opposite sides and are axially aligned with the first bore when the two link elements are matingly engaged.

11 Claims, 1 Drawing Sheet

JEWELRY LINK ASSEMBLY

BACKGROUND OF THE INVENTION

This invention relates to a link assembly for a link bracelet or other jewelry item, and more particularly to a jewelry link assembly having an improved physical appearance.

Conventional link bracelets typically use three types of link elements. These prior art link elements are referred to as a hook type, H link, and pin type; the latter requires the use of a pin across the entire link. In all of these designs, it is necessary to solder or laser heat the outside surface of the link element—this normally produces a visible joint marking on the finished link, which is visually unattractive.

In addition, both hook type and H links are disadvantageous since it is difficult to achieve a tight fit between links; alignment is also difficult.

Accordingly, it is desirable to provide a link assembly for a link bracelet which overcomes these prior art deficiencies.

SUMMARY OF THE INVENTION

Generally speaking, in accordance with the invention, a link assembly for a link bracelet or other jewelry item is provided. The link assembly includes a first link member formed with a male link element at one end and a second link member formed with a female link element at one end that is designed for pivotally and matingly engaging with the male link element of the first link member. The male link element is constructed with a first bore formed therethrough and the female element has second and third bores formed therethrough. The second and third bores are disposed on opposite sides and are axially aligned with the first bore when the two link elements are matingly engaged.

Significantly, the male link element is formed with an access opening for enabling access to the first bore. In order to couple the first link member to the second link member, a pair of specially sized pins are inserted through the opening and received within the first bore. One of the pins is slidably positioned so that it is disposed through the first bore and into the second bore. The other of the pins is slidably positioned so that it is disposed between the first bore and the third bore. These pins are then welded in place.

In accordance with the invention, the second and third bores of the female link element do not extend all the way through the respective side walls of the second link member. As a result, when the two pins are placed in position such that they extend between the first and second bore and the first and third bore respectively, they are not visible from either side of the link assembly, creating a far more aesthetically pleasing appearance.

In the preferred embodiment, the first link member and second link member have the same design. Thus, one end of the link member is formed with the male link element and the second end of the link member is formed with the female link element. In assembly, a plurality of link members may be pivotally linked with each other by engaging the female link element of one member with the male link element of a corresponding link member.

Accordingly, it is an object of the invention to provide an improved link assembly for a link bracelet or other jewelry item.

Still another object of the invention is to provide an improved link assembly in which the pin elements used for connecting corresponding links are not visible.

Yet a further object of the invention is to provide an improved link assembly that is easier to use when assembling a link bracelet or other jewelry item.

Still other objects of the invention will in part be obvious, and in part be apparent from the following description.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figures 1, 2, 3, 4:
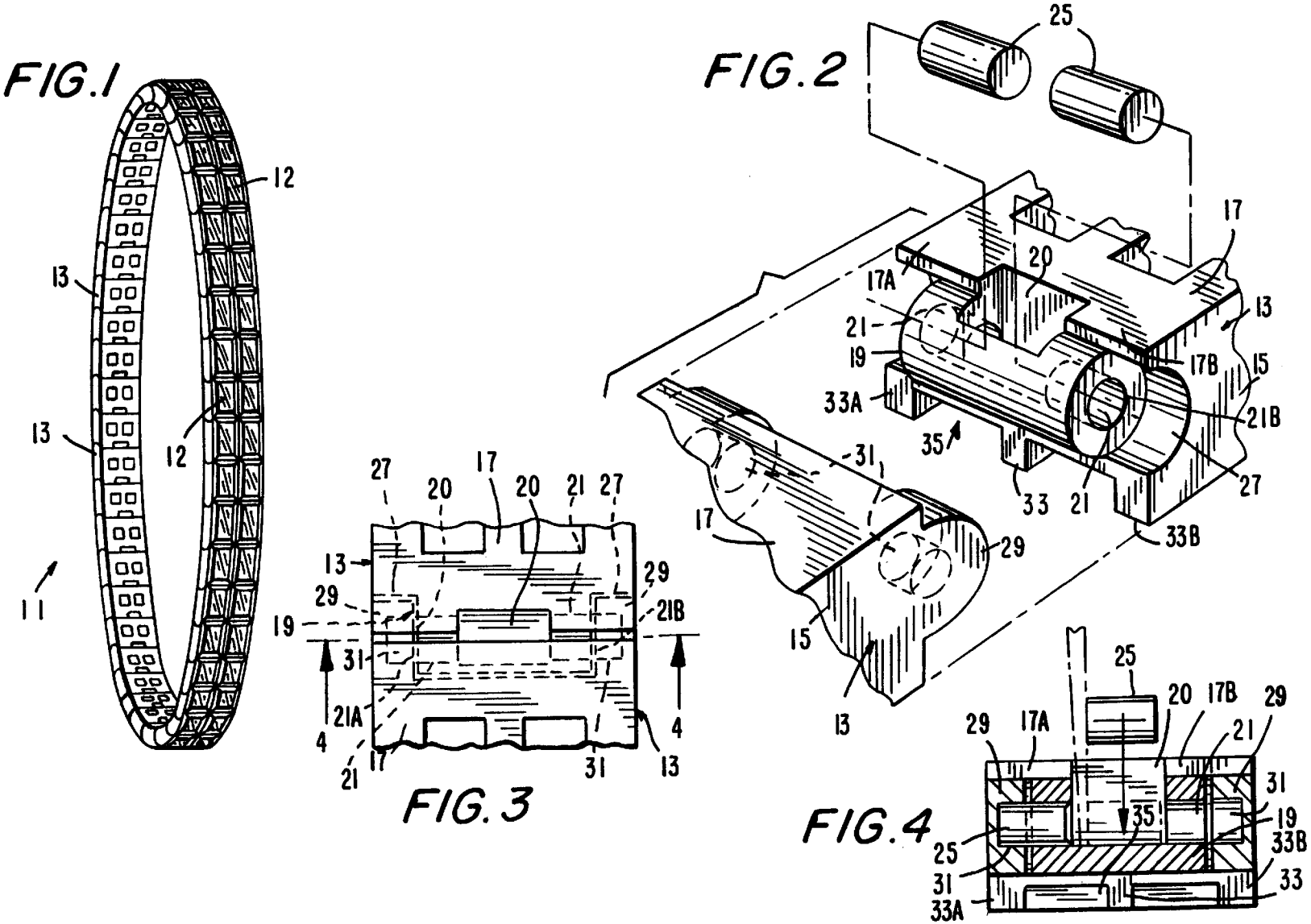
FIG. 1 is a perspective view of a jewelry link bracelet utilizing a plurality of link assemblies made in accordance with the invention.
FIG. 2 is an exploded perspective view of an individual link assembly made in accordance with the invention.
FIG. 3 is a bottom plan view of a link assembly of the invention.
FIG. 4 is a cross-sectional view taken along lines 4—4 of FIG. 3.

Referring first to FIG. 1, a jewelry link bracelet made from a plurality of link assemblies of the inventive design is generally indicated at 11. Link bracelet 11 includes a plurality of link assemblies 13 of the invention, each of which is used for carrying a pair of jewelry stones such as a diamond. As can be appreciated, what is visible along the outer surface of link assembly 11 are the stones 12, while the individual link assemblies can be seen from the underside of bracelet 11.

Turning now to FIGS. 2–4, the inventive link element 13 is described. Link assembly 13 is defined by front facing ribs 33, 33A and 33B, side walls 15 and back wall 17. Front facing ribs 33, 33A and 33B define a pair of rectangular shaped settings 35 for accommodating a pair of stones 12 (as shown in FIG. 1). As shown in FIGS. 2 and 4, back wall 17 includes a pair of rectangular shaped extending fingers 17A and 17B under which a tube element 19 is disposed. Tube element 19 is formed with an axially running bore 21 having openings 21A and 21 B on either side and access into bore 21 from the back of link element 13 is made possible by an access opening 20. Each of side walls 15 of link element 13 leads to a pivot wall 27 located adjacent bore openings 21A and 21B.

The other end of link element 13 is formed with pair of pivot elements 29 on either side which are designed for pivotally engaging pivot walls 27 of the adjacent link element. Pivot elements 29 are each formed with a bore 31 which is designed to axially align with bore 21 on either side of openings 21A and 21B when pivot elements 29 rotatably engage pivot walls 27 (see FIG. 4).

It is important to note that each of bores 31 extend only partially through pivot elements 29 (from the inside), thus not disrupting the surface of either side wall 15.

In order to assemble a first link element 13 to a second link element 13, the two link elements are coupled together by engaging pivot elements 29 with pivot walls 27 such that bore 21 of the first link element and bores 31 of the second link element are aligned, as best depicted in FIGS. 3 and 4. Then, one of pins 25 is dropped through access opening 20 and into bore 21, where it is slid completely to one side so that a portion thereof is received within one of bores 31 (see FIG. 4). Then the other pin 25 is dropped through access opening 20 and into bore 21 where it slid completely to the other side so that a portion thereof is received within the other of bores 31.

In order to fix each of pins 25 in position between bore 21 and one of bores 31, a welding process (typically by a laser)

is applied to the inside ends of each of pins 25. As can be appreciated, because each of bores 31 formed in pivot elements 29 does not extend through side wall 15, pin 25, when positioned within bores 21 and 31, as discussed above, will not be visible.

Although the inventive link element shown in the drawings holds two substantially rectangular shaped stones, the inventive link element may be designed to accommodate a single or any number of stones, and stones of various shapes, without departing from the scope of the invention.

Although the inventive link element is shown in a bracelet, the link assembly may be used also in a necklace, earring or other kind of jewelry piece in which links are used.

It will thus be seen that the objects set forth above, among those made apparent from the preceding description, are efficiently attained by the subject invention. Certain changes may be made in carrying out the invention without departing from its spirit and scope. The scope of the invention is recited in the claims found thereinbelow.

What is claimed is:

1. A link assembly for a link bracelet or necklace comprising:

a first link member formed with a male link element at one end;

a second link member formed with a female link element at one end designed for pivotal mating engagement with said male link element;

said male link element having a first bore formed therethrough and said female link element having second and third bores formed therethrough with said second and third bores disposed on opposite sides of and axially aligned with said first bore when said link elements are matingly engaged;

wherein said male link element is formed with an access opening leading to said first bore such that at least one pin is insertable therethrough and into said first bore, said at least one pin slidably moveable so that said pin extends between said first bore and one of said second and third bores.

2. The assembly of claim 1, wherein said first link member is formed with said female link element at said other end and said second link member is formed with said male link element at said other end.

3. The assembly of claim 1, wherein said access opening is formed along the underside of said first link member.

4. The link assembly of claim 1, wherein said male link element comprises a tubular member for defining said first bore.

5. The assembly of claim 4, wherein said tubular member is formed with said access opening.

6. The assembly of claim 1, wherein said female link element comprises a pair of extending shoulders.

7. The assembly of claim 6, wherein each of said shoulders is formed with said second and third bores respectively.

8. A link unit for a link bracelet or necklace comprising:

a top wall, bottom wall and pair of side walls and having a first end formed with a male link element and a second end formed with a corresponding female link element;

said male link element having a first bore formed therethrough with openings on either side thereof and said female link element having second and third bores formed therethrough with said second and third bores having inside openings which align with the openings on either side of said first bore, wherein each of said second and third bores do not extend through the corresponding side wall of said link member.

9. The link unit of claim 8, wherein said male link element is formed with a central access opening along the bottom thereof which leads to said first bore and that is sized to enable a pivot pin to drop therethrough so as to be slidably received inside said first bore.

10. A link assembly for a link bracelet comprising:

a first link member formed with a male link element at one end;

a second link member having a pair of side walls which leads to a female link element at one end that is pivotally engaged with said male link element;

said male link element having a first bore formed therethrough and said female link element having second and third bores formed therethrough with said second and third bores disposed on opposite sides of and axially aligned with said first bore;

wherein each of said second and third bores does not extend through the corresponding side wall located along said female link element of said second link member; and a pair of pivot pins with one pin disposed inside and between said first and second bores and the other pin disposed inside and between said first and third bores.

11. The link assembly of claim 10, wherein said male link element is formed with a central access opening for communicating with said first bore and which is sized to enable each of said pins to pass therethrough.

* * * * *